US009555930B2

(12) United States Patent
Campbell et al.

(10) Patent No.: US 9,555,930 B2
(45) Date of Patent: Jan. 31, 2017

(54) HANDLE ASSEMBLY FOR PLASTIC CONTAINER

(71) Applicant: KW CONTAINER, Troy, AL (US)

(72) Inventors: N Kenneth Campbell, Troy, AL (US); Darren Scholl, Troy, AL (US); Keith Rukvina, Dothan, AL (US); David Bacon, Luverne, AL (US)

(73) Assignee: KW Container, Troy, AL (US)

( * ) Notice: Subject to any disclaimer, the term of this patent is extended or adjusted under 35 U.S.C. 154(b) by 0 days.

(21) Appl. No.: 13/758,962

(22) Filed: Feb. 4, 2013

(65) Prior Publication Data

US 2013/0240550 A1 Sep. 19, 2013

Related U.S. Application Data

(63) Continuation of application No. PCT/US2012/053188, filed on Aug. 30, 2012, which is a continuation-in-part of application No. 13/221,056, filed on Aug. 30, 2011.

(60) Provisional application No. 61/674,142, filed on Jul. 20, 2012.

(51) Int. Cl.

| | |
|---|---|
| ***B65D 25/28*** | (2006.01) |
| ***B65D 25/32*** | (2006.01) |
| ***B44D 3/12*** | (2006.01) |

(52) U.S. Cl.

CPC ..... *B65D 25/2844* (2013.01); *B44D 3/12* (2013.01); *B65D 25/2873* (2013.01); *B65D 25/32* (2013.01)

(58) Field of Classification Search

USPC ..... 220/752, 759, 760, 762, 763, 764, 773,220/775, 776

See application file for complete search history.

(56) References Cited

U.S. PATENT DOCUMENTS

| | | | | |
|---|---|---|---|---|
| 3,358,877 | A | 12/1967 | Eckhoff | |
| 3,448,893 | A | 6/1969 | Jeanneau | |
| 3,469,728 | A | 9/1969 | Bailey | |
| 3,638,823 | A | 2/1972 | McCoy | |
| 4,976,369 | A | 12/1990 | Shindo et al. | |
| 5,088,615 | A | 2/1992 | Neuman | |
| 5,505,331 | A * | 4/1996 | Rathbun | 220/764 |
| 6,085,933 | A | 7/2000 | Brunazzo | |
| 6,234,782 | B1 * | 5/2001 | Hansen | 425/517 |
| 6,494,341 | B2 * | 12/2002 | Perkins et al. | 220/764 |
| 6,983,862 | B2 | 1/2006 | Nottingham et al. | |

(Continued)

FOREIGN PATENT DOCUMENTS

| | | |
|---|---|---|
| GB | 1478183 | 6/1977 |
| GB | 2211162 | 6/1989 |

(Continued)

OTHER PUBLICATIONS 4 scanned phoographs—Sherwin Williams nylon prototype circa Apr. 2003.

(Continued)

*Primary Examiner* — Fenn Mathew
*Assistant Examiner* — Madison L Poos
(74) *Attorney, Agent, or Firm* — Joseph S. Bird, III; Bradley Arant Boult Cummings LLP

(57) ABSTRACT

A system for carrying a container comprising a plastic handle with tabs for insertion into slots on the container configured so that the tabs may be inserted when the handle is not in an upright or resting position.

33 Claims, 5 Drawing Sheets

(56) References Cited

U.S. PATENT DOCUMENTS

| | | | | |
|---|---|---|---|---|
| 7,360,665 | B1 | 4/2008 | Hartelius | |
| 7,780,036 | B2 * | 8/2010 | Splain et al. | 220/774 |
| 7,857,197 | B2 | 12/2010 | Rosendall | |
| 8,267,305 | B2 | 9/2012 | Rosendall | |
| 2008/0093242 | A1 | 4/2008 | Rosendall | |
| 2008/0277418 | A1 * | 11/2008 | Vockler et al. | 222/111 |
| 2009/0032542 | A1 | 2/2009 | Temple | |

FOREIGN PATENT DOCUMENTS

| | | |
|---|---|---|
| GB | 2244972 | 12/1991 |
| GB | 2262929 | 7/1993 |
| GB | 2347915 | 11/2002 |
| GB | 2444038 | 5/2008 |
| NL | 1023927 | 7/2003 |
| WO | 9011229 | 10/1990 |
| WO | 0247921 | 6/2002 |
| WO | 2006122362 | 11/2006 |
| WO | 2007054235 | 5/2007 |

OTHER PUBLICATIONS

Bonenberger, Paul R. "The First Snap-Fit Handbook" Hansen Publishers (2005) excerpt; pp. 85-90, 152-153, 156-157.

Urbaniec, Tomasz "International Application No. PCT/US2012/053188 International Search Report and Written Opinion" European Patent Office; Nov. 29, 2012; pp. 1-13.

Butler, Derek "International Application No. PCT/AU01/01600 International Search Report" Australian Patent Office; Feb. 18, 2002; pp. 1-3.

Burrows, A. "Great Britain patent application No. 9127488.6 Search Report" Mar. 31, 1992; pp. 1-2.

Ponnampalam Saravanamuthu "Written Opinion and International Search Report—International Application No. PCT/AU2006/000658" Jun. 1, 2006; pp. 1-5.

* cited by examiner

HANDLE ASSEMBLY FOR PLASTIC CONTAINER

STATEMENT REGARDING RELATED APPLICATIONS

This application is continuation of international application PCT/US12/53188, filed on Aug. 30, 2012 (currently pending). International application PCT/US12/53188 is a continuation-in-part of U.S. patent application Ser. No. 13/221,056 filed on Aug. 30, 2011 (currently pending). International application PCT/US12/53188 claims the benefit of the filing date of U.S. provisional patent application No. 61/674,142, filed Jul. 20, 2012 (currently pending). International application PCT/US12/53188 is incorporated herein by reference in its entirety.

TECHNICAL FIELD

This disclosure relates generally to plastic structures, and more particularly to a handle system for a container.

BRIEF DESCRIPTION OF THE DRAWINGS

The present handle system will be explained, by way of example only, with reference to certain embodiments and the attached figures, in which.

DETAILED DESCRIPTION

Figure 1:
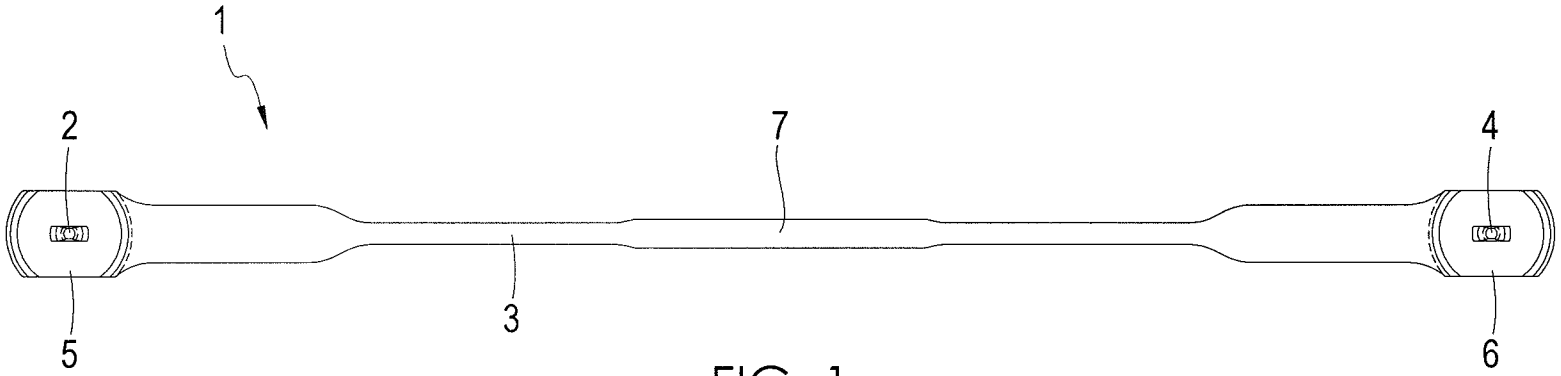
FIG. 1 is a plan view of the front side of one embodiment of a handle of the present invention.
Figure 2:
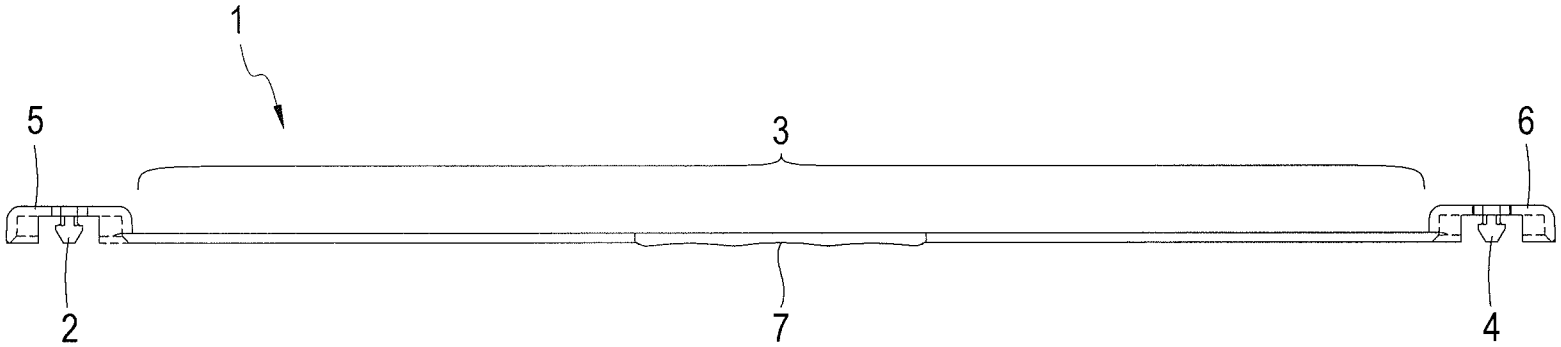
FIG. 2 is a side view of the handle of FIG. 1.

A plastic system is provided for securely attaching a movable plastic handle to a plastic container including, without limitation, a paint can. The container may be cylindrical or any other shape suitable for a particular application. The plastic in one embodiment may be polypropylene and the components described herein are formed by injection molding.

In one embodiment, as shown in FIGS. 1-2, 8, 11-12, the system comprises a handle 1 that attaches to a pair of brackets 10 on the container 8. More particularly, the handle 1, which may be of unitary construction and made of plastic, comprises a strap 3 with tabs 2, 4 projecting from the strap near either end. As shown in FIGS. 7-12, the brackets 10 are affixed to the exterior of the container 8 preferably opposite one another and comprise a slot 11. As described in more detail below, the tab and slot are sized and shaped to allow the tab to pass with force through the slot in one orientation, but to interlock such that the tab cannot be removed from the slot in all other orientations, including when the handle 1 is in use in an upright position and bearing the load of the container 8.

Referring to FIGS. 1-6, the handle 1 comprises the strap 3 with tabs 2, 4 projecting from the strap 3 near either end. In the embodiment shown, each end of the strap 3 has a cap 5, 6 in which the tabs 2, 4 are located. In another embodiment, the ends of the strap 3 do not terminate in caps and the tabs 2, 4 project from the body of the strap itself. The handle 1 is preferably symmetrical, with one end being a mirror image of the other, and therefore will be described with respect to one end only. It should be understood that such description is applicable to the corresponding features on the other end as well.

The strap 3 is sufficiently long with respect to the container to form an arc above it, when the tabs are attached to the brackets, preferably with sufficient clearance between strap 3 and the top of the container for a person to grasp the handle without interference from the top of the container. The strap 3 may include a grip 7 near its center, on the side of the strap that will face the container when attached, for comfort and security of the user.

The tab 2 comprises a three-dimensional head B that tapers from a broader base F to a narrower top A. In one embodiment the head B is attached to the strap 3 or cap 5 by a post C. The cross section of the head B of the tab 2 may be of any shape that allows its insertion into the slot 11 of the bracket 10 in one orientation and which becomes interlocked with the bracket 10 at any other orientation, including without limitation an oval, rectangle or spheroid. This generally requires the cross section to have major and minor axes, with the major axis being longer than the minor axis. Thus, the shapes described below are in all respects illustrative.

Figure 3:
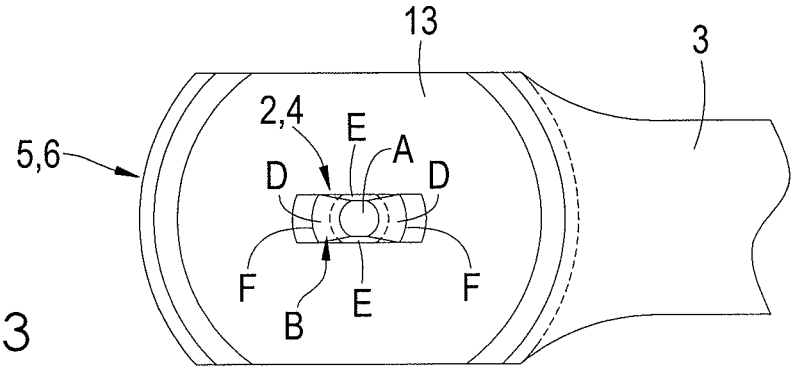
FIG. 3 is a plan view of the front side of a cap of the handle of FIG. 1.

In one embodiment, the head B is a cone or preferably a frustum. The frustum may be regular or irregular and the cross section defining its base may be any shape which generally has a major axis longer than a minor axis including, for example, a rectangle, an oval, squoval or a spheroid. The head B comprises a top A, opposing minor axis surfaces D defining the head's thickness in the direction of the minor axis, connected by opposing major axis surfaces E defining its width in the direction of the major axis. In one embodiment, the surfaces E of the head B taper from the broader base F to the narrower top A. As shown in FIG. 3, the thickness of the frustum need not be uniform from bottom to top and, in a preferred embodiment the thickness progressively decreases near the top A. In one embodiment, the cross section of the head B is rectangular and, in another embodiment, the shorter sides of the rectangle (in the direction of the minor axis) are convex. In one embodiment the major axis surfaces E may be convex or arcuate. In the embodiment shown in FIGS. 4, 6 the head B is of uniform cross section for some distance from the base F. In a preferred embodiment, the minor axis surfaces D may be convex, such that the cross section at the base F of the frustum is a rectangle with rounded corners and approaches a circle at the top A. This shape reduces deformation of the head B as it is inserted into the slot 11 of the bracket. The post C of the tab 2 may be substantially narrower than the width of the base F of the head B, and, in one embodiment, is circular in cross section. The tab 2 may be solid and of unitary construction with the cap 5.

Figure 4:
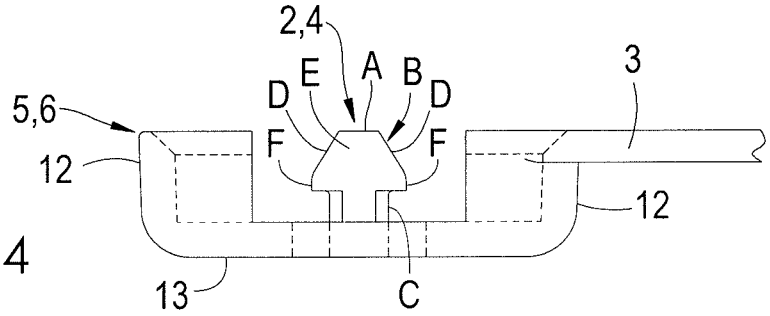
FIG. 4 is a side view of the cap of FIG. 3.
Figure 5:
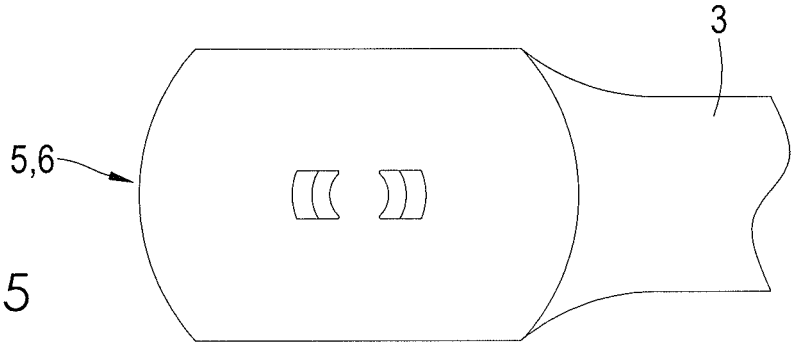
FIG. 5 is a plan view of the back side of the cap of FIG. 3.
Figure 6:
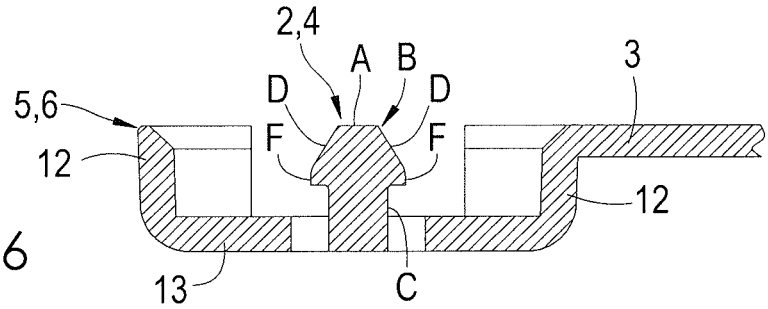
FIG. 6 is a cross section of the cap of FIG. 3.
Figure 7:
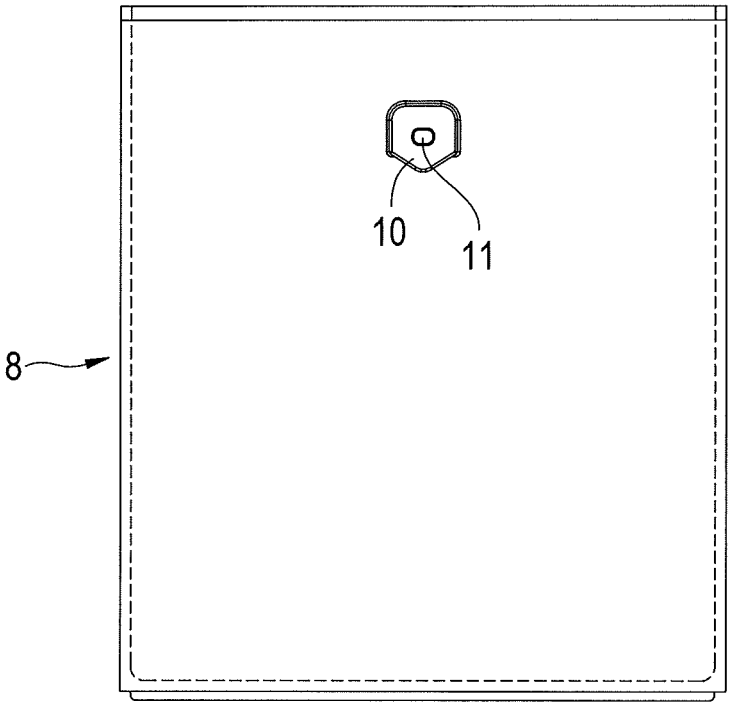
FIG. 7 is a side view a container comprising an embodiment of a bracket of the present handle system.
Figure 8:
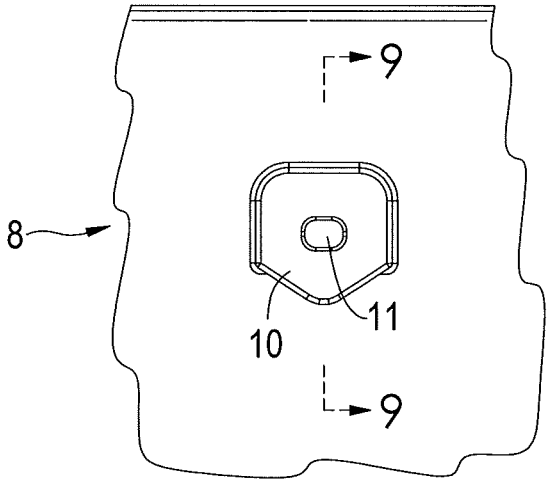
FIG. 8 is a detailed view of the bracket of FIG. 7.
Figure 9:
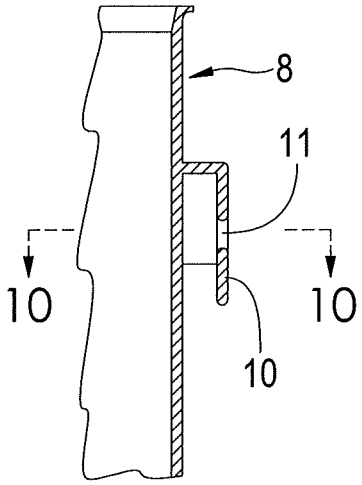
FIG. 9 is a vertical sectional view of the bracket of FIG. 7.
Figure 10:
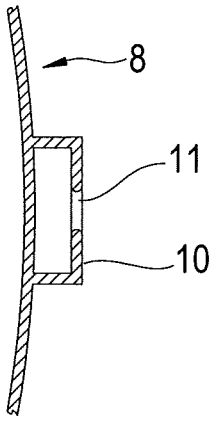
FIG. 10 is a horizontal sectional view of the bracket of FIG. 7.

The cap 5 is preferably integral with the strap 3. The cap 5 is sized and shaped to fit around—but move freely over—the bracket 10 on the container 8, when the handle 1 is attached to it. In the embodiment shown, the cap 5 comprises a floor 13 with two linear open sides between two opposing sidewalls 12, which may be defined by segments of a circle. When laid flat, the plane of the floor 13 may be substantially parallel with that of the strap 3 and offset from it by the height of the sidewall 12. The tab 2 may project perpendicularly from the floor 13 and is preferably located on the floor in the center of the circle defining the sidewalls 12. As shown, the height of the tab 2 may be the same as that of the sidewalls. The floor 13 may include cutouts or voids around the post C of the tab 2, as shown in FIGS. 4-6.

As shown in FIGS. 7-12, the brackets 10 are fixed to the outside surface of the container 8, and in some embodiments are molded integrally as part of the container. Another bracket (shown in FIGS. 11-12) is also fixed to the container, and in some embodiments is opposite the first bracket. Where the container is a cylinder, the brackets should be diametrically opposed. The bracket 10 may be of any shape and construction sufficient to space the slot 11 from the outside surface of the container 8 by a distance at least slightly larger than the height of the head B of the tab 2.

As noted above, the head B of the tab 2 and the slot 11 are sized and shaped to allow the head B in one position to be inserted into the slot 11, but some force should be required to insert the head B into the slot 11. In one embodiment, at least ten pounds of force is required to insert the head B into the slot 11. The slot 11 may be of any shape, but as with the cross section of the head B, the slot 11 should have a major axis defining its longest dimension and a minor axis defining its shortest dimension, with the major axis typically longer than the minor axis. Such shapes include an oval, squoval, rectangle or a spheroid. In the embodiment shown in FIG. 7, the slot 11 is a rectangle with rounded corners. In some embodiments, the thickness of the head B is slightly narrower than the minor axis of the slot 11, and the width of the head B at its base is slightly larger than the major axis of the slot 11, which requires force to insert the head B through the slot 11. In another embodiment, the thickness of the head B is slightly larger than the minor axis of the slot.

Figure 11:
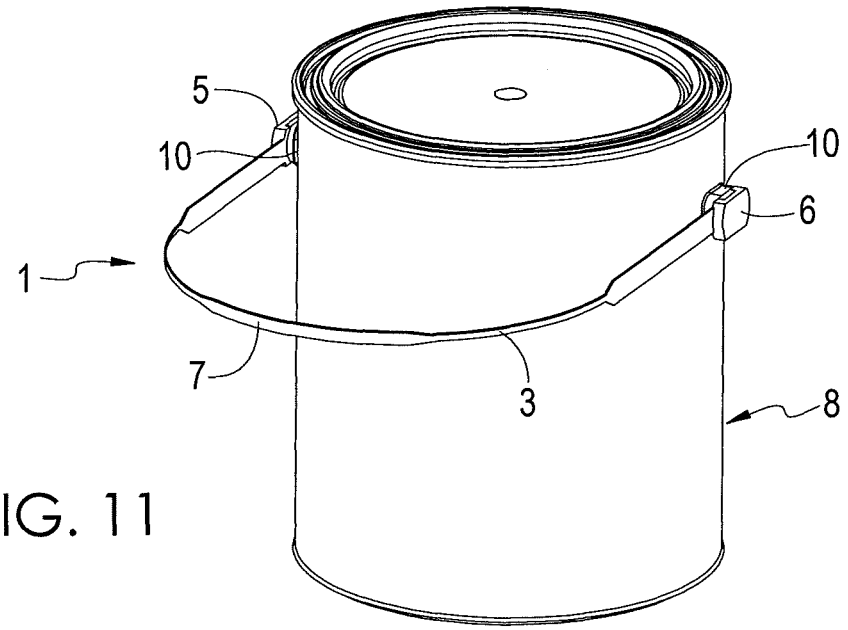
FIG. 11 is a perspective view of the handle inserted into the slots on the brackets in a horizontal position.
Figure 12:
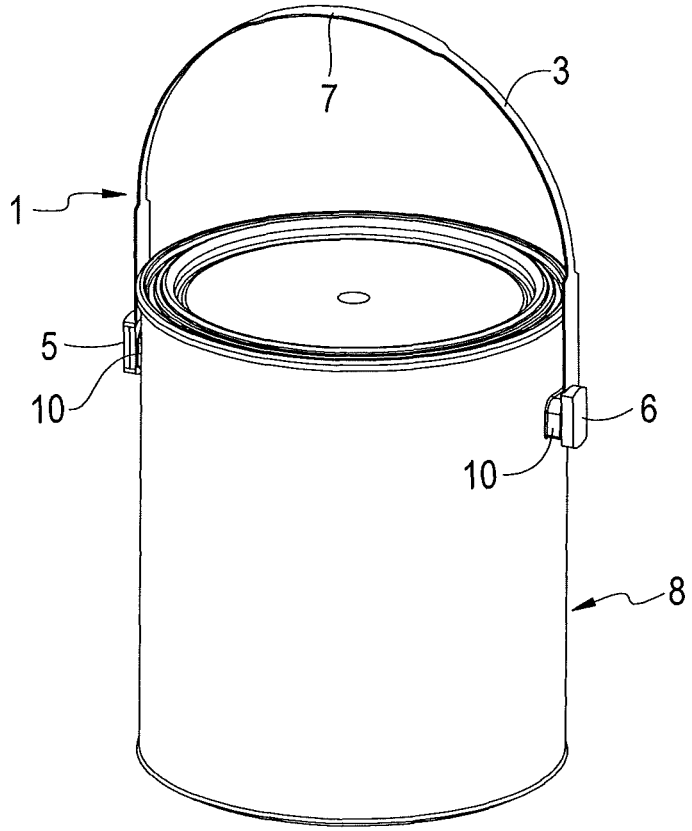
FIG. 12 is a perspective view of the handle inserted into the slots on the brackets in an upright position.

The head B is of unitary construction and is solid, i.e., of one piece. It is inserted through the slot 11 by centering the tab 2 over the slot 11 with the long axes of the head B and slot 11 aligned. The head B may then be pushed through the slot 11. After the head B of the tab 2 is inserted through the slot 11, the post C may rotate freely in the slot 11, with the base of the head B bearing against the inside of the slot 11 keeping the handle 1 connected to the container 8 when the handle is in use, for example as in FIG. 12 when the handle is in an upright position. In the embodiment shown, the long axis of the head B of the tab 2 (i.e., its width at the base) is oriented parallel to the longitudinal axis of the strap 3. The long axis of the slot 11 is parallel to the base of the container 8. Therefore, the handle 1 must be parallel to the base of the container 8 for the head B of the tab 2 to be inserted into the slot 11 as shown in FIG. 11. When the handle 1 is in any other orientation, for example an upright position (FIG. 12) or a resting position against either side of the container, the handle 1 is irremovably connected to the container 8 by the interlocking of the tab 2 and slot 11.

We claim:

1. A plastic container comprising a. a bottom and a cylindrical sidewall having opposite sides integral with a first and a second bracket, b. a plastic handle comprising a strap having two ends, a first tab located near one end of the strap and a second tab located near the other end of the strap, each of the tabs being of unitary construction and having in cross section a major axis and a minor axis, and c. a first and a second slot on the first and the second brackets, each of the slots having a major axis slightly smaller than the major axis of the tabs, and a minor axis slightly smaller than the minor axis of the tabs, so that, when the major axis of each of the tabs is aligned with the major axis of each of the slots, the tabs can be inserted into or removed from the slots, and the handle can pivot freely for an entire length of a major arc of a circle defined by the opposite sides of the cylindrical sidewall when the tabs are inserted into the slots.

2. The plastic container as in claim 1, wherein the first and second tabs are in a shape of a frustum.

3. The plastic container as in claim 2, wherein the frustum is rectangular.

4. The plastic container as in claim 3, wherein the rectangular frustum's shorter sides are convex.

5. The plastic container as in claim 1, wherein the first and second tabs extend perpendicularly from the strap.

6. The plastic container as in claim 1, further comprising the slots having a shape selected from the group consisting of a rectangle with rounded corners, an oval, a squoval, a spheroid and a rectangle.

7. The plastic container as in claim 1, further comprising a first cap integral with the first tab and a second cap integral with the second tab, one of the caps being located near each end of the strap.

8. The plastic container as in claim 7, the first and second caps further comprising a first sidewall integral with one of the ends of the strap and a floor integral with the first sidewall.

9. The plastic container as in claim 8, further comprising a second sidewall integral with the floor.

10. The plastic container as in claim 8, wherein the first and second tabs further comprise a post, said post extending from and integral with the floor of the cap, a head integral to the post, the head narrowing from a base to a top.

11. The plastic container as in claim 1, wherein the first and second tabs further comprise a post integral to the strap and a head integral to the post, the head narrowing from a base to a top.

12. A plastic container, comprising a. a bottom and a cylindrical sidewall having a first and a second bracket integral with opposite sides of the cylindrical sidewall, b. a plastic handle having upright and resting positions, said handle comprising a strap having two ends, a first tab located near one end of the strap and a second tab located near the other end of the strap, the tabs being of unitary construction, and c. a first bracket and a second bracket on opposite sides of the plastic container, comprising first and second slots which are slightly smaller than the first and second tabs, said tabs and slots configured so that when the handle is not in the upright or resting positions, the first and second tabs may be inserted into or removed from the first and second slots and, when the tabs are inserted into the slots, the handle can pivot freely along an entire length of a major arc of a circle defined by the opposite sides of the cylindrical sidewall.

13. The plastic container as in claim 12, the first and second tabs having a shape of a frustum.

14. The plastic container as in claim 13, wherein the frustum is rectangular.

15. The plastic container as in claim 14, wherein the rectangular frustum's shorter sides are convex.

16. The plastic container as in claim 12, further comprising the slots having a shape selected from the group consisting of a rectangle with rounded corners, an oval, a squoval, a spheroid and a rectangle.

17. The plastic container as in claim 12, further comprising a first cap integral with the first tab, and a second cap integral with the second tab, one of the caps being at each end of the strap.

18. The plastic container as in claim 17, wherein each of the first and second caps further comprise ,a first sidewall integral with one of the ends of the strap and a floor integral with the first sidewall.

19. The plastic container as in claim 18, further comprising a second sidewall integral with the floor.

20. The plastic container as in claim 12, wherein the first and second brackets are plastic.

21. A plastic container, comprising a. a bottom and a cylindrical sidewall having a first and a second bracket integral with opposite sides of the cylindrical sidewall, b. a plastic handle comprising a strap having two ends, a first cap integral to one end of the strap and a second cap integral to the other end of the strap, said caps comprising a first sidewall and a floor, a first tab and a second tab being of unitary construction and further comprising a post integral with the floor and having a height above the floor, a head integral to the post, the head being in the shape of a rectangular frustum with rounded corners and having shorter sides which are convex, and c. a first bracket with a first rectangular slot and a second bracket with a second rectangular slot integral to opposite sides of the plastic container, each of said slots having a major axis and a minor axis with rounded corners, said slots having a thickness which is slightly smaller than the height of the post, so that the first and second tabs can be inserted into or removed from the first and second slots and, when the tabs are inserted into the slots, the handle can pivot freely along the entire length of a major arc of a circle defined by the opposite sides of the cylindrical sidewall.

22. The plastic container as in claim 21, in which the first and second caps further comprise a second sidewall integral to the floor.

23. The plastic container as in claim 21, wherein the major axes of the slots are parallel to a base of the container.

24. The plastic container as in claim 21, wherein the slots are slightly smaller than the tabs.

25. The plastic container as in claim 1, wherein the tabs rotate freely when the handle pivots.

26. The plastic container as in claim 11, wherein the posts rotate freely when the handle pivots.

27. The plastic container as in claim 1, wherein the handle can pivot freely to any position along a major arc of a circle defined by the opposite sides of the container.

28. The plastic container as in claim 21, wherein the tabs rotate freely when the handle pivots.

29. The plastic container as in claim 21, wherein the posts rotate freely when the handle pivots.

30. A plastic container comprising a. a bottom and a cylindrical sidewall having a first and a second bracket integral with opposite sides of the cylindrical sidewall, b. a plastic handle comprising a strap having two ends, a first tab located near one end of the strap and a second tab located near the other end of the strap, each of the tabs (1) being of unitary construction and (2) comprising a head having a shape of a frustum with a base and a top and comprising in cross section a major axis and a minor axis, said major axis having two major axis surfaces defining a thickness of the frustum and said minor axis having two minor axis surfaces, and c. a first and a second slot on the first and second brackets, each of the slots having a major axis slightly smaller than the major axis of the head of the tabs, and a minor axis slightly smaller than the minor axis of the head of the tabs, so that, when the major axis of each of the tabs is aligned with the major axis of each of the slots, the tabs can be inserted into or removed from the slots and, when the tabs are inserted into the slots, the handle can pivot freely along an entire length of a major arc of a circle defined by the opposite sides of the cylindrical sidewall.

31. The plastic container as in claim 30 wherein at least one of the two minor axis surfaces is convex.

32. The plastic container as in claim 30 wherein the thickness of the frustum progressively decreases near the top.

33. The plastic container as in claim 30 wherein at least one of the two major axis surfaces is convex.

* * * * *